US007784774B2

(12) United States Patent
Fuller et al.

(10) Patent No.: US 7,784,774 B2
(45) Date of Patent: Aug. 31, 2010

(54) ASSEMBLY METHOD AND APPARATUS

(75) Inventors: Anthony B. Fuller, Mooresville, NC (US); Ralf Strauβ, Wörthsee (DE); Matthew Shute, Charlotte, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 26 days.

(21) Appl. No.: 11/379,242

(22) Filed: Apr. 19, 2006

(65) Prior Publication Data

US 2007/0246874 A1 Oct. 25, 2007

(51) Int. Cl.
*B25B 5/00* (2006.01)

(52) U.S. Cl. ..... 269/6; 269/3; 269/166

(58) Field of Classification Search ..... 269/3, 269/6, 166, 169, 168, 204, 139, 16, 285
See application file for complete search history.

(56) References Cited

U.S. PATENT DOCUMENTS

| | | | | | |
|---|---|---|---|---|---|
| 4,231,557 | A | * | 11/1980 | Blachly et al. | 269/139 |
| 4,850,254 | A | | 7/1989 | Burney | |
| 4,926,722 | A | | 5/1990 | Sorensen et al. | |
| 5,005,449 | A | | 4/1991 | Sorensen et al. | |
| 5,009,134 | A | | 4/1991 | Sorensen et al. | |
| 5,022,137 | A | | 6/1991 | Sorensen et al. | |
| 5,094,131 | A | | 3/1992 | Sorensen et al. | |
| 5,170,682 | A | | 12/1992 | Sorensen et al. | |
| 5,222,420 | A | | 6/1993 | Sorensen et al. | |
| 5,476,474 | A | * | 12/1995 | Davis et al. | 606/182 |
| 5,680,932 | A | | 10/1997 | Dickinson et al. | |
| 5,775,680 | A | | 7/1998 | Sorensen et al. | |
| 5,988,616 | A | | 11/1999 | Fuller et al. | |
| 6,299,152 | B1 | * | 10/2001 | Sangmeister et al. | 269/139 |
| 6,302,386 | B1 | | 10/2001 | Fuller et al. | |
| 6,347,791 | B1 | | 2/2002 | Chervenak | |
| 6,367,787 | B1 | | 4/2002 | Poole et al. | |
| 6,412,767 | B1 | | 7/2002 | Beckmann et al. | |
| 6,568,667 | B1 | | 5/2003 | Hall | |
| 6,860,179 | B2 | | 3/2005 | Hopper et al. | |
| 7,017,894 | B1 | * | 3/2006 | Lin | 269/6 |
| 2004/0069668 | A1 | | 4/2004 | Finnigan | |
| 2007/0246874 | A1 | * | 10/2007 | Fuller et al. | 269/6 |

FOREIGN PATENT DOCUMENTS

| | | |
|---|---|---|
| DE | 3917473 | 2/1990 |
| DE | 19731579 | 1/1999 |
| EP | 0997233 | 1/2003 |
| GB | 2427539 | 1/2007 |
| WO | 2006136858 A1 | 12/2006 |

* cited by examiner

*Primary Examiner*—Lee D Wilson
(74) *Attorney, Agent, or Firm*—Dennis J. Williamson; Moore & Van Allen, PLLC; R. Brian Drozd

(57) ABSTRACT

The assembly method of the invention uses a cartridge that is separate from the housing of the device being manufactured. The cartridge is configured such that the location of the various components is defined and the components are easily accessed. The cartridge and its components may be assembled off of the main assembly line. Once the cartridge is assembled, the cartridge and assembled components can be placed in the housing. The assembly of the device can then be completed.

25 Claims, 6 Drawing Sheets

ASSEMBLY METHOD AND APPARATUS

BACKGROUND

The invention relates generally to clamps and other multiple component devices and more particularly to a method and apparatus for assembling such devices.

Bar clamps, such as disclosed in U.S. Pat. Nos. 4,926,722, 5,009,134, 5,022,137 and 6,367,787, comprise a housing that supports a fixed jaw, a bar that carries a movable jaw and that is supported by the fixed jaw for reciprocating movement such that the movable jaw can be moved towards and away from the fixed jaw. The housing further supports a drive and brake mechanism for controlling the movement of the bar. The drive and brake mechanisms can vary but typically consist of a number of interrelated components such as friction plates, springs, drive levers, brake levers and the like. These components are assembled directly in the clamp housing on the main assembly line. It has been found that this assembly is difficult due in part to the number of components, the lack of open access to the assembly when in the handle, the relatively complex interaction of the components and the fact that the springs may be assembled under tension and/or compression. While this assembly problem has been specifically identified with respect to bar clamps, it will be appreciated that the same assembly difficulties are encountered in the assembly of other devices that have the same or similar characteristics.

Thus, an improved method and apparatus for assembling multiple component devices is desired.

SUMMARY

The assembly method of the invention uses a cartridge that is separate from the housing of the device being manufactured. The cartridge is configured such that the location of the various components is defined and access to the components during assembly is facilitated. The cartridge and its components may be assembled off of the main assembly line. Once the cartridge is assembled, the cartridge and assembled components can be placed in the housing. The assembly of the device can then be completed.

DETAILED DESCRIPTION OF PREFERRED EMBODIMENTS OF THE INVENTION

One embodiment of the cartridge of the invention will be described with specific reference to the bar clamp shown in FIGS. 1 and 2. It will be appreciated that the cartridge and the method of assembly using the cartridge may be used on bar clamps having different internal drive and brake mechanisms of which a number of different designs are known. Moreover, it is to be understood that the cartridge of the invention and the method of assembly using the cartridge may be used to facilitate the assembly of multi-component products other than bar clamps.

Figure 1:
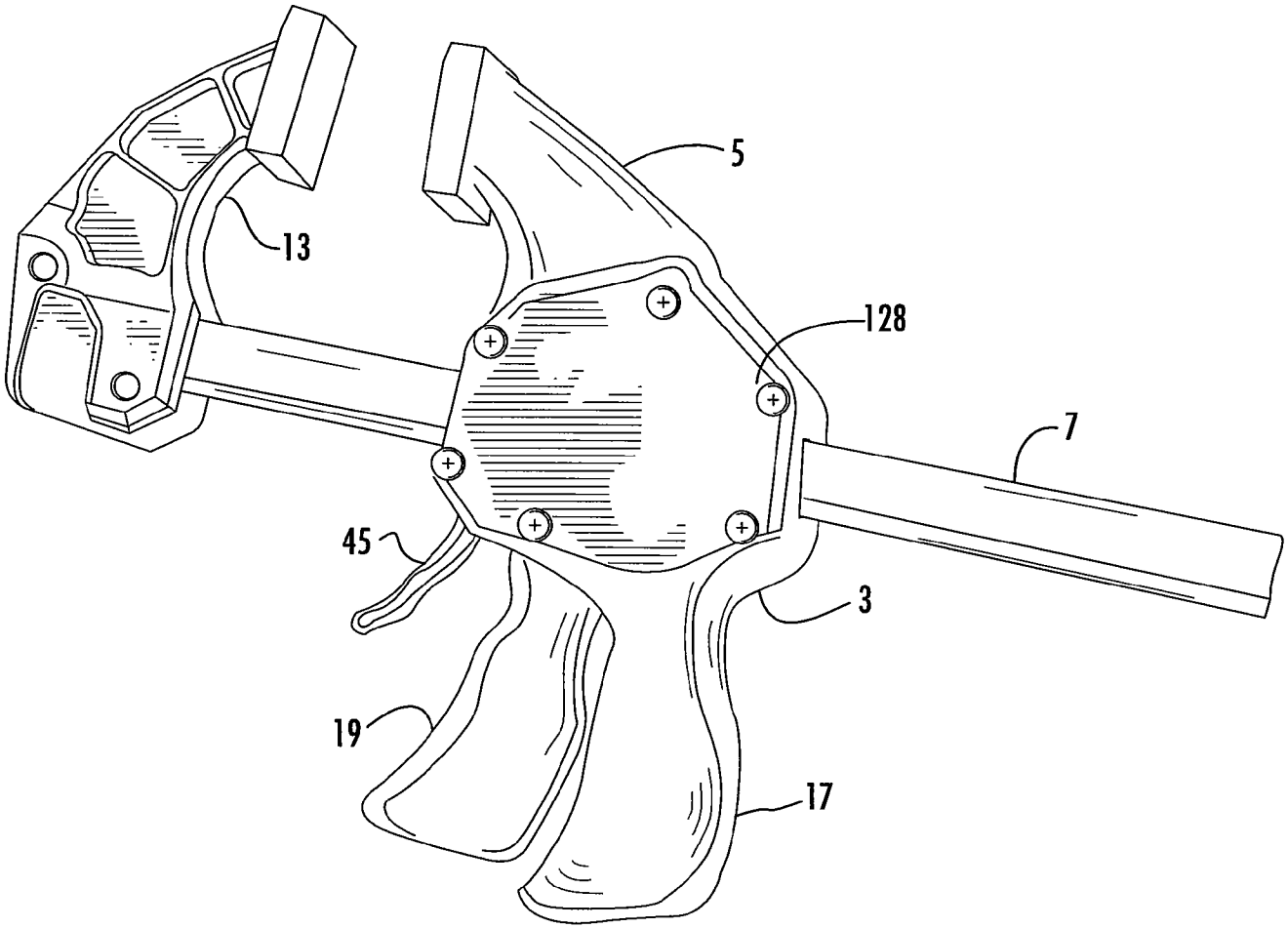
FIG. 1 is a side elevational view of a bar clamp.
Figure 2:
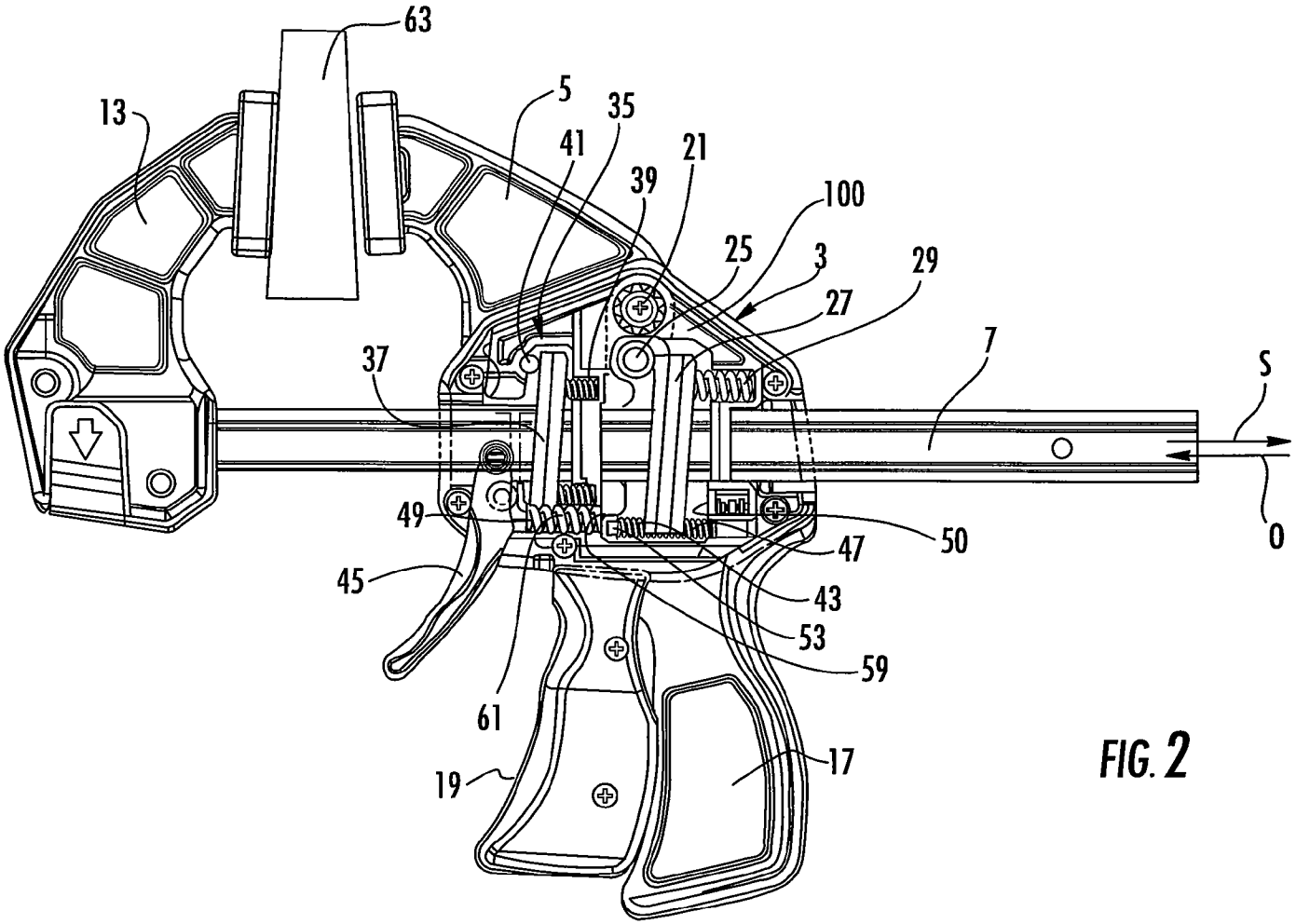
FIG. 2 is a side elevational view of the bar clamp of FIG. 1 with the housing cover removed to show one implementation of the cartridge of the invention.
Figure 3:
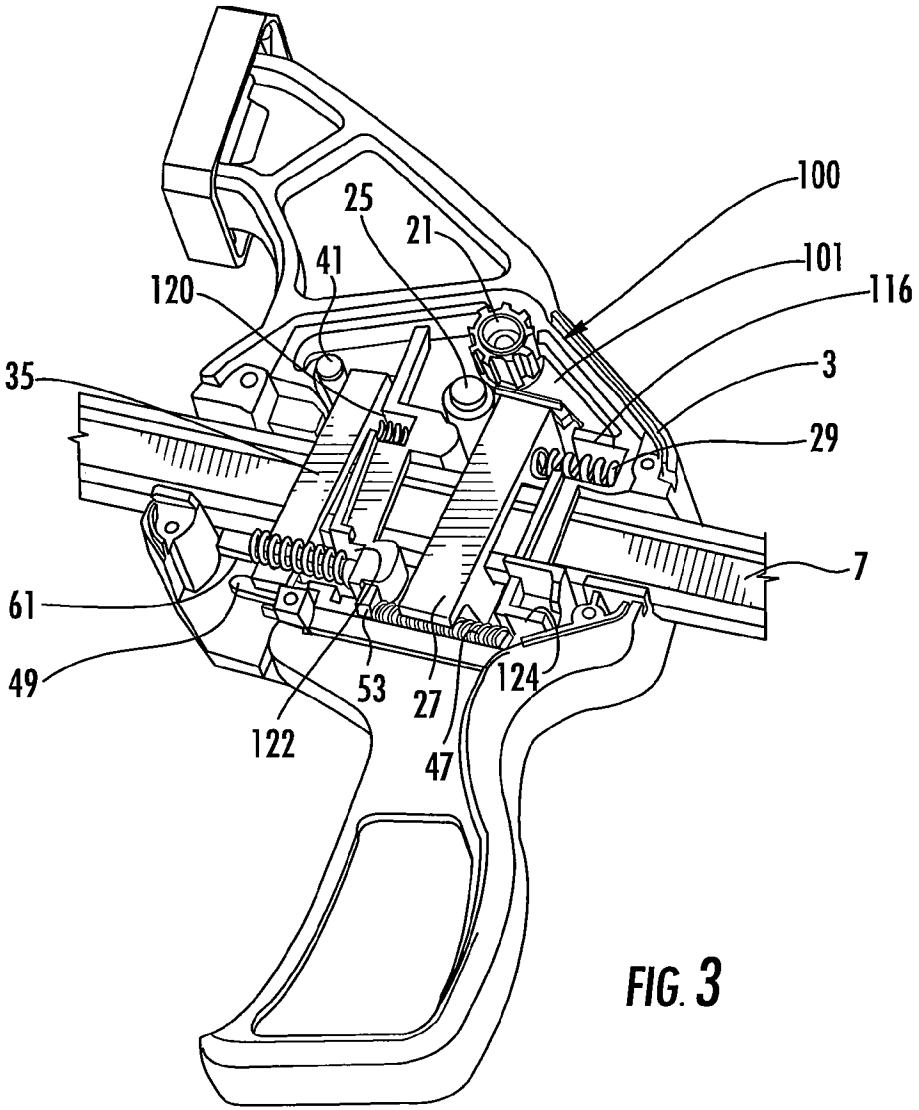
FIG. 3 is a partial perspective view of the drive assembly of FIG. 1.
Figure 4:
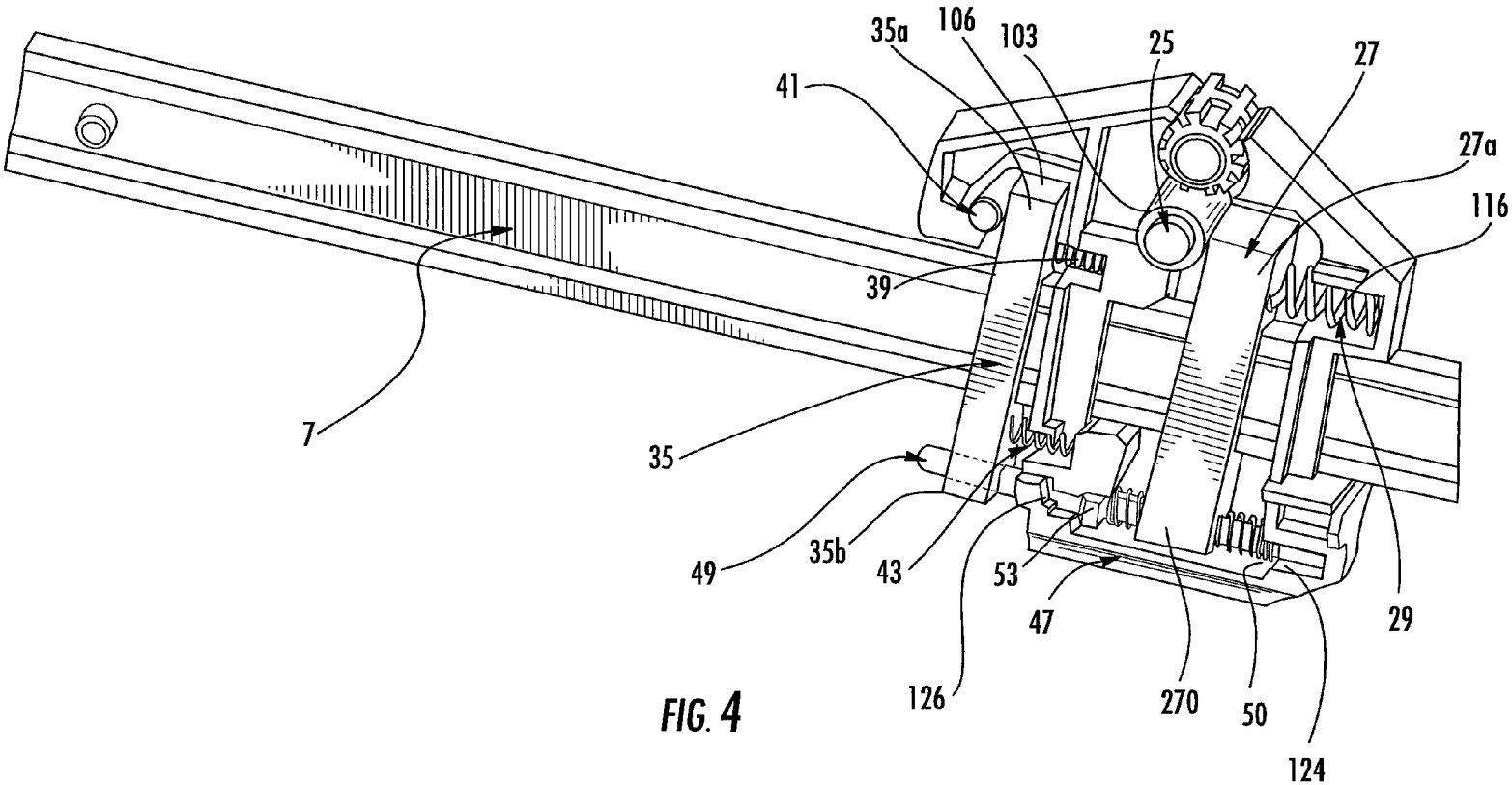
FIG. 4 is a partial perspective view of one embodiment of the cartridge of the invention and the assembled components.
Figure 5:
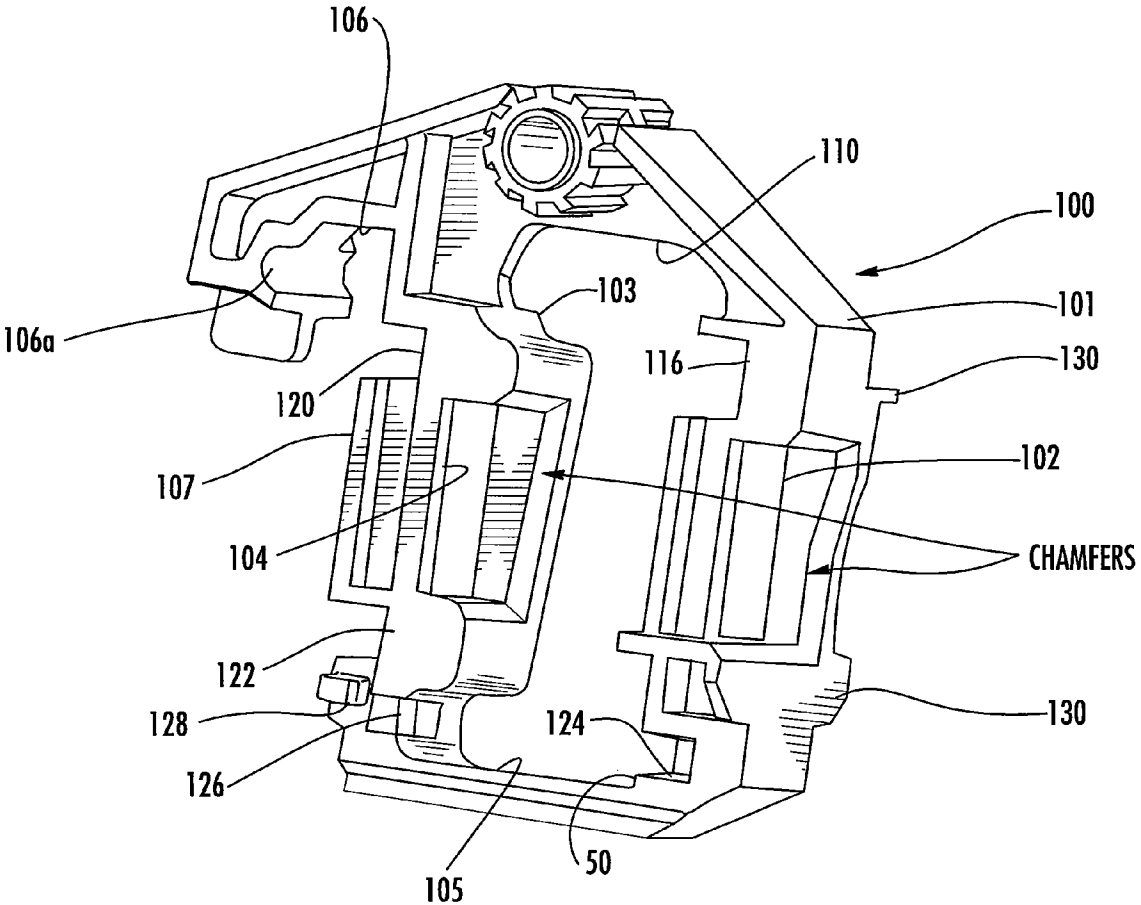
FIG. 5 is a partial perspective view of one embodiment of the cartridge of the invention without the components.

Referring to FIGS. 1 and 2 the clamping tool comprises a housing 3 on which a stationary jaw 5 is mounted and in which a bar 7 is supported for displacement in a longitudinal direction. A movable jaw 13 is mounted at one end of bar 7 and may be oriented with respect to stationary jaw 5 to create a clamping or spreading configuration. A handle member 17 is formed integrally with housing 3. An actuating arm 19 is pivoted to the support at swivel joint 21 to allow pivoting of the actuating arm 19 towards and away from handle member 17. A cylindrical projecting stop 25 is carried by the actuating arm 19 and is located below the swivel joint 21. Stop 25 engages the entrainment plates of entraining slide element 27.

The entraining slide element 27 forms part of a stepping gear that is actuated by actuating arm 19 for displacing bar 7 in the direction of arrow S. The stepping gear comprises a helical compression spring 29 oriented parallel to bar 7 that acts on the entraining slide element 27 below the cylindrical stop 25. The helical compression spring 29 is mounted under such a bias as to pivot the entraining slide element 27 into canting engagement with the bar 7. The canting of the entraining slide element 27 into engagement with bar 7 blocks the movement of bar 7 in the direction of arrow O.

The stepping gear also comprises a draw-back lock 35 formed by a wedging plate 37 which is brought into canted blocking engagement with the bar 7 as it is pivoted around stationary pivot pin 41 by compression spring 39 and a secondary spring 43. Arranging the compression spring 39 and the secondary spring 43 as a pair prevents the wedging plate 37 from being shifted in clamping direction S due to friction when bar 7 is displaced in clamping direction S.

The draw back lock 35 further comprises a release lever 45 to be actuated by an operator so as to engage the lower end of wedging plate 37 to lift the canting thereof. The release lever 45 is in constant contact with tappet 49 which is biased by spring return 47 into engagement with release lever 45 and supported parallel to bar 7. Return spring 47 is disposed between a projection 53 formed near the center of tappet 49 and an abutment surface 50 of housing 3 and presses the tappet in the direction of release lever 45. Centering spring 61 urges the actuating arm 19 in the direction of handle member 17. Internal of housing 3 the actuating arm 19 is drawn in dashed lines to better illustrate the various components of the bar clamp.

To clamp a workpiece 63, actuating arm 19 is pressed toward handle member 17 such that entraining slide element 27 is moved by stop 25 into engagement with bar 7 to move bar 7 in the direction of arrow S. To release workpiece 63, the operator actuates release lever 45. Release lever 45 contacts the bottom edge of draw back lock 35 to release the draw back lock. Further retraction of release lever 45 forces projection 53 of tappet 49 into engagement with the bottom of entraining slide element 27 to also release the entraining slide element 27 and fully release bar 7. The mechanism described for driving and releasing the bar 7 is designed to dissipate the stored clamping or spreading forces created when significant pressure has been applied to the workpiece by clamping jaws 5 and 13. While a specific bar clamp drive and brake system has been described it will be appreciated that the benefits of the method and apparatus for assembling the bar clamp can be used with other bar clamp designs including, but not limited to, the designs described in U.S. Pat. Nos. 4,926,722, 5,009,134, 5,022,137 and 6,367,787.

Referring to FIGS. 2 through 5 the cartridge of the invention is shown generally at 100 consisting of a rigid body 101 made of plastic, metal or other rigid material. Body 101 has an open framework or lattice-type structure that defines windows or apertures such as window 105 and open area 107 that extend through the body to allow access to most or all of the components from either side of the cartridge. Body 101 also defines component receptacles, such as pockets 103 and 106*a*, cavities 10, 116, 120, 122 and 124 and apertures 102 and 104 as will hereinafter be described, positioned at predetermined locations for receiving the device components.

Actuating arm 19 is pivotally mounted on pivot 21 such that stop 25 is located in pocket 103 of cavity 110. The body 101 has a first aperture 102 and a second aperture 104 formed therein for receiving the bar 7. The edges of apertures 102 and 104 are chamfered to allow the bar 7 to slide relative thereto with minimum resistance. As the bar 7 is threaded through the apertures 102 and 104, the bar is also threaded through entraining slide elements 27 and draw back lock 35. The draw back lock 35 is located with its first end 35*a* located in a cavity 106 formed in cartridge 100. Stationary pivot pin 41 is located in pocket 106*a* of cavity 106 such that the first end of draw back lock 35*a* will pivot about pivot pin 41 when a force is applied to the opposite end 35*b* of the draw back lock. Pivot pin 41 can be made integrally with cartridge 100 where cartridge 100 is intended to remain a permanent part of the finished device. Alternatively pivot pin 41 may be made as a separate component that is fixed to cartridge 100 such as by being fixed in a mating hole formed in the cartridge. Moreover, pivot pin 41 can form part of housing 3 where the pivot pin 41 is used to properly orient cartridge 100 in housing 3 when the cartridge is loaded into the housing. Similarly entraining slide elements 27 are located in the cartridge with their first ends 27*a* located in a cavity 110 formed in cartridge 100 such that the first end of entraining slide elements 27*a* will pivot about stop 25 of actuating arm 19 when a force is applied to the opposite ends 27*b* of the entraining slide elements.

The helical compression spring 29 is located in a cavity 116 in cartridge 100 to exert a force on the first end 27*a* of the entraining slide elements 27. Cavity 116 can be dimensioned such that the spring can press fit through a narrowed passage to hold the spring in the cavity during assembly. Other mechanisms for retaining the springs in the cavities may also be used. Likewise, compression springs 39 and 43 are located in cavities 120 and 122, respectively, to exert a force on the draw back lock 35.

One end of tappet 49 is located in cavity 124 and tappet 49 extends through aperture 126. Return spring 47 is located over tappet 49 before tappet 49 is located in cartridge 100 such that the return spring is trapped between projection 53 on the tappet and abutment surface 50 on the cartridge. Centering spring 61 is constrained between cavity 122 and arm 19.

The cartridge is also provided with a mating interface comprising mating elements for aligning and orienting the cartridge when it is inserted into the housing. For example, the mating element may include the periphery of the cartridge that has an asymmetrical shape that nests with a mating shape formed in the interior space of the housing such that the cartridge can be inserted into the housing in only one orientation. The mating element may also be formed of male projections 130 formed on body 101 that mate with female receptacles in the housing. The mating elements may also be formed of the male projections on the housing such as pin 41 that mate with female receptacles on the cartridge such as pocket 106*a*. Combinations of different mating elements may also be used.

Because the cartridge has an open framework that is open on both sides, the device can be assembled by accessing either side of the cartridge to locate the various drive and brake elements. Access from both sides of the assembly is not possible where the components are assembled directly in the housing. Moreover, the cartridge allows modifications to the components without the need to modify the rest of the device. For example, it may be desireable to make the same device in multiple versions where one version is made with heavy duty components and another version is made with standard components. The cartridge can be designed to receive different components or different cartridges can be used for different components. Because the cartridge is assembled separate from the main device assembly process, components can be interchanged without affecting the main assembly process. Where different cartridges with, for example, different shaped receptacles are used, the mating interfaces on the different types of cartridges are the same such that the different types of cartridges may be used with the same housing.

Once the components are located in the cartridge, the cartridge and the components supported thereon can be located in housing 3. A housing cover 128 can be secured to housing 3 by screws or other fasteners to maintain the cartridge and components in position in the housing and complete the assembly. A structure other than the housing cover can be used to retain the components and cartridge in position in the housing such as a separate plate, bands or other structure.

Figure 6:
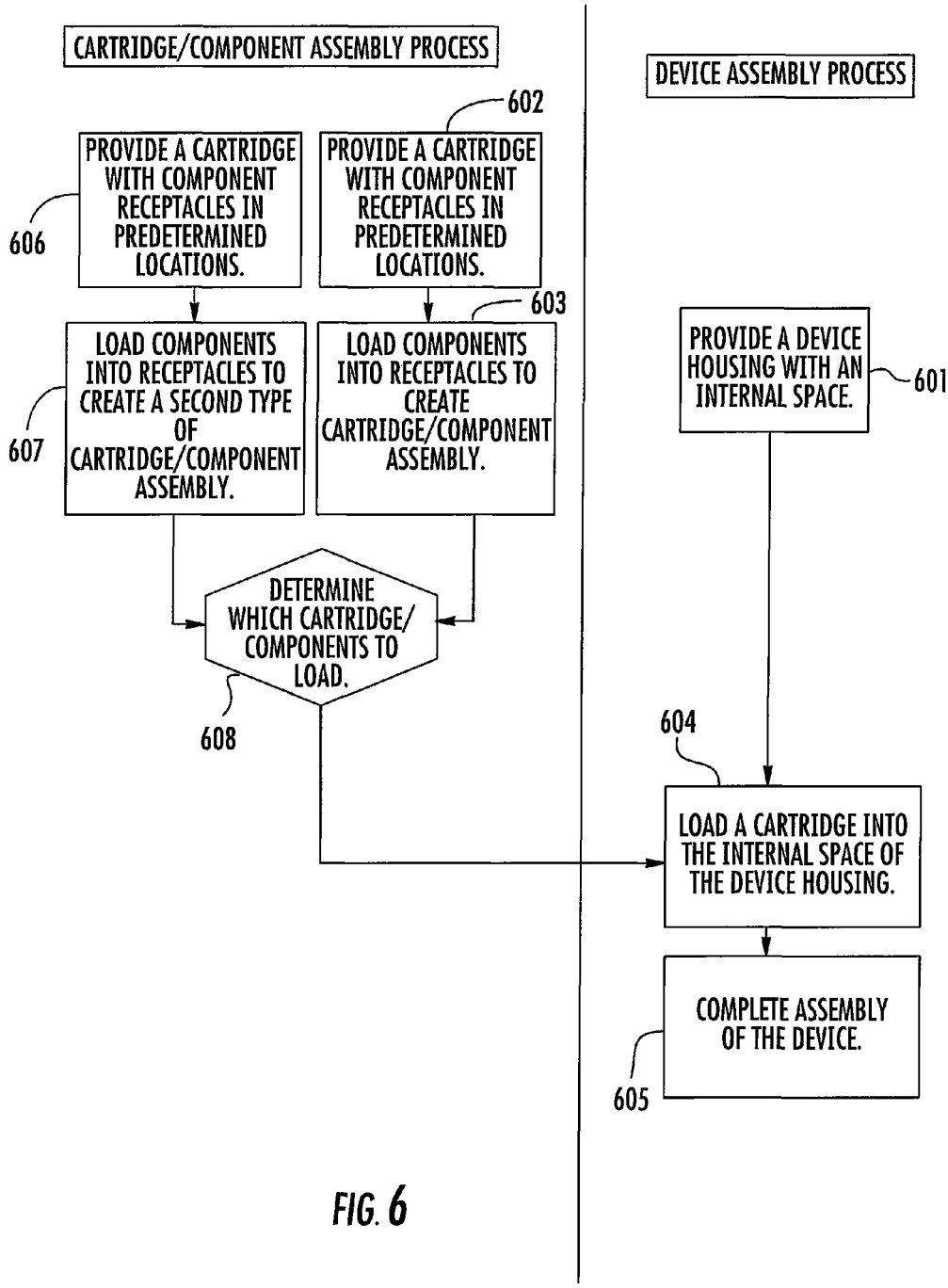
FIG. 6 is a block diagram showing the assembly method of the invention.

The method of assembling a device will now be described with reference to FIG. 6. A device housing is provided that includes an internal space for receiving a cartridge (block 601). The internal space includes a mating interface, such as a shaped periphery or mating male and female elements, that are used to orient and locate the cartridge within the housing. A separate cartridge is provided that defines predetermined component locations for receiving various interrelated components of the device (block 602). In one embodiment these components consist of the drive and brake elements for a bar clamp. The cartridge comprises an open structure such that the components can be accessed from either side of the cartridge to facilitate the locating of the components in the cartridge. The cartridge includes a mating inteerface such as a shaped periphery or mating male and/or female structure that mate with the corresponding structure on the housing to orient the cartridge in the housing. The components are loaded into the cartridge in the component receptacles in the predetermined locations (block 603). The cartridge is then located, along with all of the loaded components in the device housing at the proper orientation to create a cartridge/component assembly (block 604). Once the cartridge is located in the housing a housing cover or other structure is used to retain the cartridge and components in place and further assembly of the device may be performed to complete the device in the device assembly process if necessary (block 605). In one embodiment another cartridge is provided that may be identical to or different from the first cartridge (block 606). Components of a second type are loaded into the cartridge to create a second type of cartridge/component assembly (block 607). Each of the different types of cartridges fit into the same device housing and include the same mating elements such that the different cartridges can be used in the same device. A determination is made as to which of the different types of cartridges is to be loaded in the device (block 608). The selected cartridge and component is loaded into the device (block 604) and the assembly of the device is completed (block 605). If only one type of cartridge and components is used, process steps 606, 607 and 608 can be eliminated. Moreover, more than two different types of cartridge/component assemblies may be used. The assembly of the cartridge with its associated components can be performed off-line from the assembly of the complete device. The cartridge and assembly can then be brought as a unit to the device assembly process and loaded into the device housing.

The invention has been described where the cartridge remains in the housing in the finished product. It will be appreciated that the cartridge and housing could be designed such that the cartridge is used to locate the components in the housing but is removed from the housing before assembly of the device is completed. This can accomplished by designing the cartridge such that the various components sit in the component receptacles positioned in the predetermined locations but are not physically restrained therein. The internal space of the housing includes component receptacles that mate with the component receptacles of the cartridge. The cartridge, loaded with the components, is placed in the housing such that the components are received in the component receptacles of the housing. The cartridge is then removed from the housing. This can be accomplished by loading the cartridge, placing the housing on top of the loaded cartridge, flipping the housing and cartridge over such that the components are disposed in the component receptacles of the housing and then removing the cartridge.

The invention has been described with specific reference to bar clamps. It is to be understood that the cartridge and associated method of manufacture may be used to assemble other devices that use a multiplicity of components in a housing. Specific embodiments of an invention are disclosed herein. One of ordinary skill in the art will recognize that the invention has other applications in other environments. Many embodiments are possible. The following claims are in no way intended to limit the scope of the invention to the specific embodiments described above.

What is claimed is:

1. A bar clamp comprising:

a housing supporting a first jaw, said housing including a handle connected with an actuating arm and release mechanism, and defining a first mating interface;

a bar;

a second jaw mounted on said bar;

a cartridge removably and attachably located in said housing such that said cartridge is not secured to said housing, said cartridge supporting one end of the actuating arm such that said actuating arm is not directly supported by said housing, another end of said actuating arm extending out of said housing adjacent the handle such that the handle and said actuating arm are gripped by a hand of a user, said bar being movably supported in said cartridge and to one side of said housing, said cartridge defining a second mating interface that mates with the first mating interface to orient the cartridge relative to the housing, said cartridge further includes a slide element which moveably engages the bar; and a cover secured to the housing for retaining the cartridge in the housing such that the cartridge is located within the housing and said bar is disposed between the cartridge and the cover.

2. The bar clamp of claim 1, wherein said cartridge includes component receiving receptacles and components located in the component receiving receptacles.

3. The bar clamp of claim 2 wherein one of the components comprises a spring.

4. The bar clamp of claim 3 wherein said spring is located in one of the component receiving receptacles under compression.

5. The bar clamp of claim 1 further comprising a cover for retaining the cartridge in the housing.

6. The bar clamp of claim 1 wherein the first mating interface comprises one of a female receptacle or a male protrusion.

7. The bar clamp of claim 1 wherein the second mating interface comprises one of a female receptacle or a male protrusion.

8. The bar clamp of claim 1 wherein the cartridge is open to allow access to the components from either side of the cartridge.

9. The bar clamp of claim 1 wherein one of the components comprises a spring.

10. The bar clamp of claim 9 wherein said spring is located in one of the component receiving receptacles under one of compression or tension.

11. An apparatus comprising:

a housing supporting a first jaw, said housing including a handle and defining a first mating interface;

an actuating arm connected with the housing;

a release lever;

a bar;

a second jaw mounted on said bar; and a cartridge removably and attachably located in said housing, said cartridge supporting one end of the actuating arm, another end of said actuating arm extending from said housing such that said actuating arm is gripped by a hand of a user; said bar being movably supported in said cartridge, said cartridge defining a second mating interface that mates with the first mating interface defined by the housing to orient the cartridge relative to the housing, said cartridge being connected with a slide element which moveably engages the bar.

12. The apparatus of claim 11, further comprising a cover for retaining the cartridge in the housing.

13. The apparatus of claim 11, wherein the first mating interface includes one of a female receptacle or a male protrusion.

14. The apparatus of claim 11, wherein the second mating interface includes a one of a female receptacle or a male receptacle.

15. The apparatus of claim 11, wherein the cartridge is open to allow access to the components from either side of the cartridge.

16. The apparatus of claim 11, wherein one of the components comprises a spring.

17. The apparatus of claim 16, wherein said spring is located in one of the component receiving receptacles under one of compression or tension.

18. The apparatus of claim 11, further comprising a cover secured to the housing for retaining the cartridge in the housing such that the cartridge is located within at least a portion of the housing and said bar is disposed between the cartridge and the cover.

19. A apparatus comprising:

a housing supporting a first jaw, said housing including a handle and defining a first mating interface;

an actuating arm connected with the housing;

a release lever;

a bar;

a second jaw mounted on said bar; and at least one cartridge removably and attachably located in said housing, said at least one cartridge in communication with one end of the actuating arm, another end of said actuating arm extending from said housing such that said actuating arm can be actuated by a user; said bar being supported by said at least one cartridge and being moveable within said at least one cartridge, said at least one cartridge defining a second mating interface that mates with the first mating interface defined by the housing to orient the at least one cartridge relative to the housing, said at least one cartridge being connected with a slide element which moveably engages the bar.

20. The apparatus of claim 19, further comprising a cover for covering the cartridge in the housing.

21. The apparatus of claim 19, wherein the first mating interface includes one of a female receptacle or a male protrusion.

22. The apparatus of claim 19, wherein the second mating interface includes a one of a female receptacle or a male receptacle.

23. The apparatus of claim 19, wherein the cartridge is open to allow access to the components from either side of the cartridge.

24. The apparatus of claim 19, wherein one of the components comprises a spring that is located in one of the component receiving receptacles under one of compression or tension.

25. The apparatus of claim 19, further comprising a cover secured to the housing for retaining the cartridge in the housing such that the cartridge is located within the housing and said bar is disposed between the cartridge and the cover.

* * * * *